US011674779B2

(12) United States Patent
Binek et al.

(10) Patent No.: US 11,674,779 B2
(45) **Date of Patent: *Jun. 13, 2023**

(54) BULLET, WEAPON PROVIDED WITH SUCH BULLETS, KIT FOR ASSEMBLING THE SAME, AND CORRESPONDING METHODS OF MANUFACTURING, OPERATING AND USE ASSOCIATED THERETO

(71) Applicant: Next Dynamics Corp., Westmount (CA)

(72) Inventors: Anthony A Binek, Montreal (CA); Gabriel Idan Romagnolo, Cote-St-Luc (CA); Lawrence A Binek, Glastonbury, CT (US)

(73) Assignee: Next Dynamics Corp., Westmount (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/515,673

(22) Filed: Nov. 1, 2021

(65) Prior Publication Data

US 2022/0074720 A1 Mar. 10, 2022

Related U.S. Application Data

(63) Continuation of application No. 16/497,861, filed as application No. PCT/CA2018/050398 on Mar. 29, 2018, now Pat. No. 11,162,768.
(Continued)

(51) Int. Cl.
*F42B 5/10* (2006.01)
*F42B 10/40* (2006.01)
(Continued)

(52) U.S. Cl.
CPC ..... *F42B 5/10* (2013.01); *F42B 10/40* (2013.01); *F42B 5/025* (2013.01); *F42B 5/16* (2013.01)

(58) Field of Classification Search
CPC .. F42B 5/10; F42B 10/40; F42B 5/025; F42B 5/16
See application file for complete search history.

(56) References Cited

U.S. PATENT DOCUMENTS 466,056 A 12/1891 Bott
2,941,469 A 6/1960 Barnhart
(Continued)

FOREIGN PATENT DOCUMENTS

EP 2811256 12/2014
WO 1991011676 8/1991

*Primary Examiner* — J. Woodrow Eldred
(74) *Attorney, Agent, or Firm* — Stephen T. Scherrer; Monique A. Morneault; Scherrer Patent & Trademark Law, P.C.

(57) ABSTRACT

A bullet including a drag-reducing assembly provided about its main body, and configured for being triggered upon a blast from a cartridge, in order to reduce a resulting base drag of the bullet during flight trajectory. The drag-reducing assembly includes at least one cavity being configured for receiving and containing a portion of gun gas from the cartridge and corresponding blast, and at least one peripheral orifice for releasing gun gas from the at least one cavity during the flight trajectory of the bullet, in order to fill a partial vacuum behind the bullet during flight trajectory, and thus reduce the resulting base drag, for an improved overall ballistic performance of the bullet.

20 Claims, 5 Drawing Sheets

Related U.S. Application Data

(60) Provisional application No. 62/478,305, filed on Mar. 29, 2017.

(51) Int. Cl.
*F42B 5/02* (2006.01)
*F42B 5/16* (2006.01)

(56) References Cited

U.S. PATENT DOCUMENTS

| | | | | |
|---|---|---|---|---|
| 3,345,948 | A | 10/1967 | Sarvis | |
| 3,754,507 | A | 8/1973 | Dillinger et al. | |
| 3,913,487 | A | 10/1975 | Scherr et al. | |
| 3,988,990 | A | 11/1976 | MacDonald, Jr. et al. | |
| 3,995,558 | A | 12/1976 | Travor et al. | |
| 4,003,313 | A | 1/1977 | Puchalski | |
| 4,091,732 | A | 5/1978 | Schadow | |
| 4,108,073 | A | 8/1978 | Davis | |
| 4,133,265 | A | 1/1979 | Diesinger et al. | |
| 4,213,393 | A | 7/1980 | Gunners et al. | |
| 4,528,911 | A | 7/1985 | DePhillipo et al. | |
| 4,742,774 | A | 5/1988 | Flatau | |
| 5,353,711 | A | 10/1994 | Botticelli et al. | |
| 6,186,072 | B1 | 2/2001 | Hickerson, Jr. et al. | |
| 6,581,522 | B1 | 6/2003 | Julien et al. | |
| 7,171,905 | B2 | 2/2007 | Hirt et al. | |
| 7,823,510 | B1 | 11/2010 | Hobart et al. | |
| 8,122,833 | B2 | 2/2012 | Nielson et al. | |
| 8,291,828 | B2 | 10/2012 | Glasser | |
| 8,511,233 | B2 | 8/2013 | Nilsson | |
| 2008/0035008 | A1 | 2/2008 | Riess et al. | |
| 2016/0131465 | A1* | 5/2016 | Harrison | F42B 14/00 102/439 |
| 2021/0302141 | A1* | 9/2021 | Kennedy | F42B 5/08 |

* cited by examiner

BULLET, WEAPON PROVIDED WITH SUCH BULLETS, KIT FOR ASSEMBLING THE SAME, AND CORRESPONDING METHODS OF MANUFACTURING, OPERATING AND USE ASSOCIATED THERETO

FIELD OF THE INVENTION

The present invention relates to a projectile (or simply "bullet"), hereinafter referred to also as a "Nemesis Projectile" or "Nemesis Bullet" or simply "Nemesis" (trademark expression(s) used by the Applicant(s)). More particularly, the present invention relates to a new and improved projectile for use with various types of firearms, and also relates to method for assembling the same, and to corresponding methods of manufacturing, operating and/or use associated thereto.

BACKGROUND OF THE INVENTION

Firearms and the various types of ammunitions used therewith (ex. projectiles, etc.), are well known in the art, and have been used for many years. It is also well known that these have evolved over the years, and have been the object of various patent applications.

For example, known to the Applicant(s) is U.S. Pat. No. 3,913,487, granted on Oct. 21, 1975, in the name of SCHERR, and relating to a "projectile". This document describes a projectile of the type adapted to be propelled from a gun barrel by expanding gas. The projectile is formed with a chamber in its base and an outlet passage leading from the chamber through the base. The chamber is of nonuniform cross-sectional area with the cross-sectional area generally diminishing from a wall at the nose end of the chamber to the outlet passage. The wall of the nose end of the chamber may vary in shape from concave through flat to convex. The chamber may vary in shape from generally hemispheric to generally conical. In a modified form of the invention, at least two chambers are formed in the base and connected in series.

U.S. Pat. No. 7,823,510 B1 granted on Nov. 2, 2010, in the name of HOBART et al., relates to an "extended range projectile". This document describes a projectile and method of extending the range of the projectile. The projectile includes a storage tank operable to release a working fluid through an exhaust manifold to at least partially fill a wake aft of the projectile during projectile flight.

U.S. Pat. No. 3,345,948, granted on Oct. 10, 1967, in the name of SARVIS, relates to a "projectile". This document describes a projectile that comprises a body having a chamber or cavity therein, closed at the rear and open at the front. A gas generating charge is disposed in the rear end portion of the cavity. The charge may be of any type well known to one skilled in the munitions art which will produce hot combustion gases while doing substantially little or no damage to the body.

U.S. Pat. No. 4,133,265, granted on Jan. 9, 1979, in the name of DIESINGER et al., relates to a "training projectile". This document describes a training projectile having an auxiliary drive mechanism for counteracting the aerodynamic resistance to which the projectile is exposed during the training flight phase of projectile travel. The auxiliary drive mechanism preferably is in the form of a rocket or jet drive. The training projectile is also provided with a mass so that the ratio of the resultant axial force to the mass of the training projectile is at least approximately equal to the ratio of the resistance force to the mass of a corresponding live projectile during the training flight phase.

Also known to the Applicant(s) are the following documents: U.S. Pat. Nos. 2,941,469; 3,754,507; 3,988,990; 3,995,558; 4,003,313; 4,091,732; 4,108,073; 4,213,393; 4,528,911; 4,742,774; 5,353,711; 6,186,072 B1; 6,581,522 B1; 7,171,905 B2; 8,122,833 B2; 8,291,828 B2; 8,511,233 B2; US 2008/0035008 A1; EP 2,811,256 A1; and WO 1991/011676 A2.

Despite these known improvements over the years, there is a need to continue innovating and finding better and/or different ways of firing projectiles improving its performances, in terms of accuracy, range and terminal energy.

Indeed, it is known that a conventional bullet in flight forms a partial vacuum immediately therebehind. This partial vacuum or low pressure area creates a force which acts on the projectile in a direction opposite to its motion thereby lessening the flight velocity of the projectile. This force is commonly referred to as "base drag". Drag may be defined as that force acting on the projectile in a direction opposite to its motion. Base drag is that drag acting on the projectile at its base.

In regards to conventional projectiles (or "bullets"), it is also known that they are affected by a pressure difference that occurs on the rearward face (i.e. "base drag"). This drop in pressure causes drag and can generate flight instability. These factors will reduce the precision and accuracy of a projectile grouping, for example.

Thus, it would be particularly useful to be able to provide an improved bullet which, by virtue of its design and components, would be able to overcome or at least minimize some of these known drawbacks associated with conventional bullets.

SUMMARY OF THE INVENTION

An object of the present invention is to provide a new projectile (hereinafter referred to also simply as "bullet") which, by virtue of its design and components, is intended to satisfy the above-mentioned need and which is thus an improvement over other related bullets, corresponding weapons, associated accessories and/or firing devices, systems, assemblies and/or methods known in the prior art.

In accordance with the present invention, the above main object is achieved, as will be easily understood, with a bullet (and/or a corresponding weapon and/or associated accessory provided with at least one such bullet, as well as corresponding kits for assembling the same (ex. bullet, weapon, etc.), and corresponding methods of manufacturing, assembling, operating, use, etc.) such as the one(s) briefly described herein and such as the ones exemplified in the accompanying drawings.

More particularly, and according to one aspect of the present invention, an objective is to provide a bullet for use with a cartridge for propulsion out of a barrel of a weapon, the bullet comprising:

a main body acting as a projectile; and a drag-reducing assembly provided about the main body, and configured for being triggered upon a blast from the cartridge, in order to reduce a resulting base drag of the bullet during a flight trajectory, the drag-reducing assembly comprising:

at least one cavity being disposed within a portion of the main body, and being configured for receiving and containing a portion of gun gas from the cartridge and corresponding blast thereof, the at least one cavity including a cross-sectional profile being substantially constant along a given segment of a longitudinal axis of the bullet; and at least one peripheral orifice provided about the main body of the bullet and in fluid communication with the at least one cavity, the at least one peripheral orifice being configured for releasing gun gas from the at least one cavity during the flight trajectory of the bullet, in order to fill a partial vacuum behind the bullet during flight trajectory, and thus reduce the resulting base drag of the bullet during flight trajectory, for an improved overall ballistic performance of the bullet.

Other possible aspect(s), objective(s), embodiment(s) and/or advantage(s) of the present invention, all being preferred and/or optional, are briefly summarized hereinbelow.

For example, and as will be explained in greater detail hereinbelow, the present system is particularly advantageous in that, due to its components and features, the bullet is capable of considerably increased ballistic performances (ex. more precise trajectory, much longer range, greater travelling speed, more powerful impact, etc.).

According to another aspect of the present invention, there is also provided a bullet for use with a cartridge for propulsion out of a barrel of a weapon, the bullet comprising a main body acting as a projectile and a drag-reducing assembly provided about the main body. The drag-reducing assembly is configured for being triggered upon a blast from the cartridge, in order to reduce a resulting drag of the projectile during flight trajectory, thereby improving resulting ballistic performance of the bullet.

According to another aspect of the present invention, there is also provided a bullet configured to be propelled by a blast of a cartridge. The bullet comprises a main body provided with an internal body cavity and has a frontward section and a rearward section provided with an opening in fluid communication with the internal body cavity. The internal body cavity by means of the opening is capable of recovering a portion of gun gas resulting from the blast of the cartridge.

According to another aspect of the present invention, there is also provided a kit with corresponding components for assembling a bullet according to the present disclosure.

According to another aspect of the present invention, there is also provided a corresponding weapon (ex. rifle, etc.) and/or an associated accessory (ex. loader, etc.) provided with at least one of the above-mentioned bullet(s), and preferably, with a plurality of such bullets.

According to another aspect of the present invention, there is also provided a weapon system comprising a weapon and at least one bullet according to the present disclosure.

According to another aspect of the present invention, there is also provided a kit with corresponding components for assembling a weapon system according to the present disclosure.

According to another aspect of the present invention, there is also provided a method of reducing drag from a bullet propelled out of a barrel of a weapon via a cartridge, the bullet having a main body, the method comprising the steps of:

providing at least one internal body cavity about the main body of the bullet;

recovering a portion of gun gas resulting from a blast of the cartridge during firing of the weapon, and conveying said portion of gun gas into said at least one internal body cavity of the bullet via a corresponding fluid passage; and allowing gun gas present inside said at least one internal body cavity of the bullet to exit as the bullet exits the barrel of the weapon, thereby fluidly filling a void behind the bullet during flight trajectory, in order to reduce a resulting drag of the bullet, for an improved overall ballistic performance of the bullet.

According to another aspect of the present invention, there is also provided a method of reducing drag from a bullet propelled by a blast of a cartridge. The method comprises the step of providing a bullet having a main body provided with an internal body cavity and comprising a frontward section, a rearward section and an opening. The opening is formed in the rearward portion and in fluid communication with the internal body cavity. The method further comprises the steps of recovering a portion of gun gas resulting from the blast of the cartridge in the internal body cavity via the opening, and allowing gun gas present inside the internal body cavity to exit via the opening as the bullet is propelled.

According to another aspect of the present invention, there is also provided a method for manufacturing a drag-reducing assembly configured to be assembled with a main body of a bullet and to reduce a resulting drag of the bullet during flight trajectory, the method comprising the steps of:

manufacturing a nozzle component having an inlet face and an outlet face, and a through opening extending between the inlet and outlet faces;

manufacturing a body portion having at least one internal body cavity, said at least one internal body cavity being in fluid communication with the through opening of the nozzle component; and at least one of the nozzle component and the body portion being manufactured by additive manufacturing.

According to another aspect of the present invention, there is also provided a method for manufacturing a nozzle component for a bullet. The method comprises the step of manufacturing the nozzle component with an inlet face, an outlet face, and a through opening that extends between the inlet and outlet faces.

According to another aspect of the present invention, there is also provided a method of manufacturing (ex. making, assembling, etc.) the above-mentioned bullet, weapon and/or associated accessory.

According to another aspect of the present invention, there is also provided a method of operating and/or using the above-mentioned bullet, weapon and/or associated accessory.

According to another aspect of the present invention, there is also provided an assembly, a system, a station and/or a machine for carrying out the above-mentioned method(s).

According to another aspect of the present invention, there is also provided a processing plant provided with any one and/or at least one of the above-mentioned assembly, system, station, machine and/or components thereof.

According to another aspect of the present invention, there is also provided a method of manufacturing (ex. producing, assembling, etc.) the above-mentioned bullet, weapon, accessory, assembly, system, station, machine, processing plant and/or components thereof.

According to another aspect of the present invention, there is also provided a method of operating the above-mentioned assembly, system, station, machine, processing plant and/or components thereof.

According to another aspect of the present invention, there is also provided a kit with corresponding components for assembling the above-mentioned bullet, weapon, associated accessory and/or components thereof.

According to another aspect of the present invention, there is also provided a set of components for interchanging with components of the above-mentioned kit.

According to another aspect of the present invention, there is also provided a method of assembling components of the above-mentioned kit and/or set.

According to another aspect of the present invention, there is also provided a method of doing business with the above-mentioned bullet, weapon, associated accessory, method(s), kit, set, assembly, system, station, machine, processing plant and/or components thereof.

According to another aspect of the present invention, there is also provided a bullet (ex. a blank and/or body with hollowed portions) having been obtained and/or processed (modified, altered, etc.) with the above-mentioned method(s), kit, set, assembly, system, station, machine, processing plant and/or components thereof.

The objects, advantages and other features of the present invention will become more apparent upon reading of the following non-restrictive description of preferred embodiments thereof, given for the purpose of exemplification only, with reference to the accompanying drawings.

DETAILED DESCRIPTION OF PREFERRED EMBODIMENTS OF THE INVENTION

Figure 1:
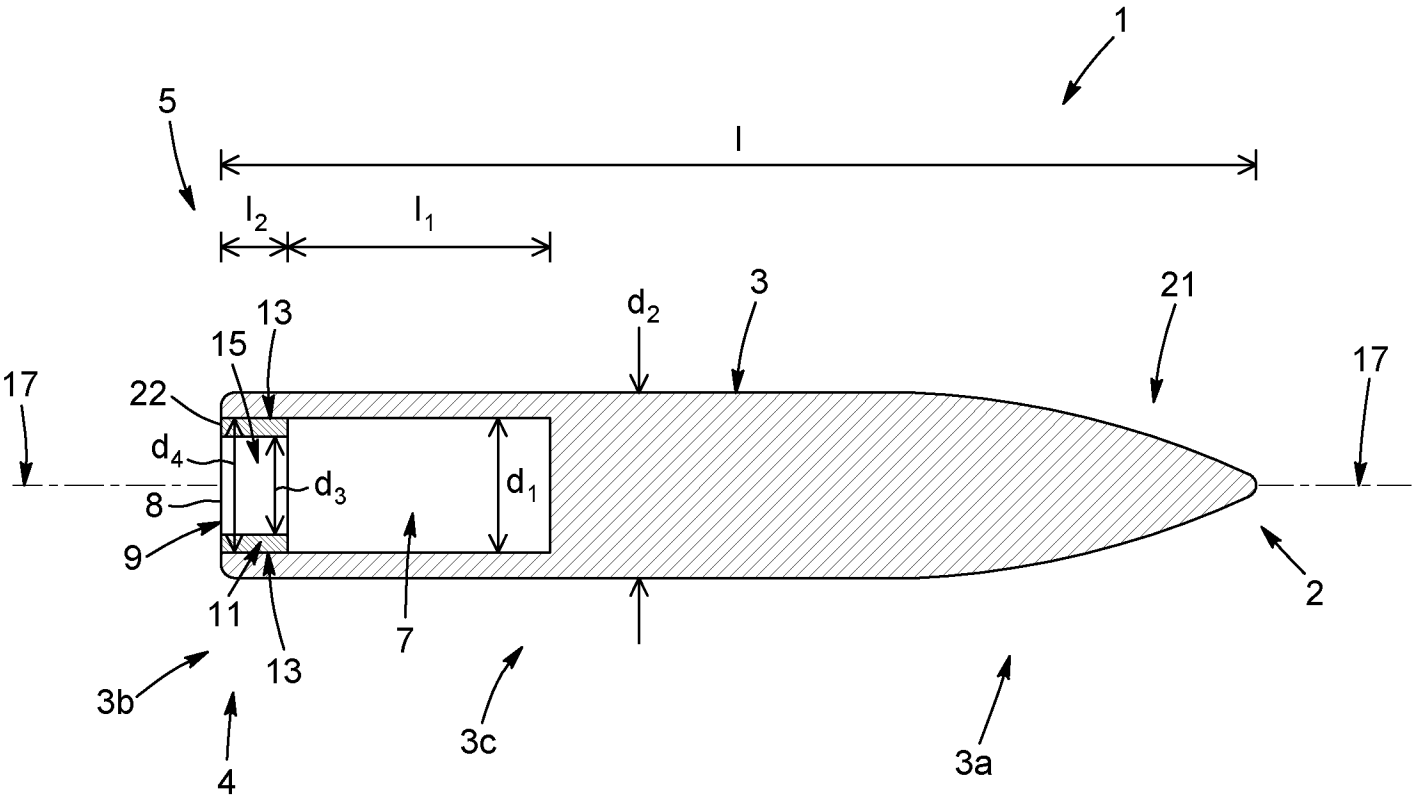
FIG. 1 is a schematic cross-sectional representation of a bullet according to a possible embodiment of the present invention, referred to herein also as "passive boost bullet" or "generation 1".

In the following description, the same numerical references refer to similar elements. Furthermore, for sake of simplicity and clarity, namely so as to not unduly burden the figures with several reference numbers, only some figures have been provided with reference numbers, and components and features of the present invention illustrated in other figures can be easily inferred therefrom. The embodiments, geometrical configurations, materials mentioned and/or dimensions (expressed in inches, for example) shown in the figures are preferred, for exemplification purposes only.

Moreover, although the present invention was primarily designed as a bullet for use with various types of weapons, such as rifles and the like, it may be used with other types of objects, and in other fields, as apparent to a person skilled in the art. For this reason, expressions such as "bullet", "weapon", "rifle", etc., used herein should not be taken as to limit the scope of the present invention and include all other kinds of objects or fields with which the present invention could be used and may be useful, as apparent to a person skilled in the art.

Moreover, in the context of the present invention, the expressions "bullet", "projectile", "device", "product", "system", "method", "kit" and "assembly", as well as any other equivalent expressions and/or compounds word thereof known in the art will be used interchangeably, as apparent to a person skilled in the art. This applies also for any other mutually equivalent expressions, such as, for example: a) "bullet", "Nemesis", "system", "product", "assembly", "device", "apparatus", "unit", "component", "equipment", "projectile", etc.; b) "producing", "manufacturing", "assembling", "making", "processing", "altering", "modifying", "changing", etc.; c) "body", "shell", "chassis", "support", "frame", etc.; d) "removing", "reducing", "diminishing", etc. e) "drag", "resistance", "friction", etc.; f) "hollow", "cavity", "hole", "recess", "grove", etc.; g) "cartridge", "propellant", "fuel", "explosive", etc.; h) "blast", "explosion", "ignition", "propulsion", etc.; i) "gun gas", "combustion gas", etc.; j) "cutting", "detaching", "separating", etc.; as well as for any other mutually equivalent expressions, pertaining to the aforementioned expressions and/or to any other structural and/or functional aspects of the present invention, as also apparent to a person skilled in the art.

Furthermore, in the context of the present description, it will be considered that all elongated objects will have an implicit "longitudinal axis" or "centerline", such as the longitudinal axis of an elongated bullet, or the centerline of a hole, for example (and as a result, there is a "transversal axis" being substantially "perpendicular" for each longitudinal axis, etc.), and that expressions such as "connected" and "connectable", or "mounted" and "mountable", may be interchangeable, in that the present invention also relates to a kit with corresponding components for assembling a resulting fully assembled and operational bullet, for use with various types of weapons, such as rifles and the like (and/or the present invention also relates to a weapon provided with at least one of such bullet(s), to a kit for assembling the same (ex. bullet, weapon, associated accessory, etc.), and to corresponding methods of manufacturing, operating and/or use associated thereto, etc.).

Moreover, components of the bullet(s), weapon(s), associated accessory(ies) and/or steps of the method(s) described herein could be modified, simplified, altered, omitted and/or interchanged, without departing from the scope of the present invention, depending on the particular applications which the present invention is intended for, and the desired end results, as briefly exemplified herein and as also apparent to a person skilled in the art.

In addition, although the preferred embodiment of the present invention as illustrated in the accompanying drawings may comprise various components, and although the preferred embodiments of the bullet, weapon, accessory and/or associated method(s) (ex. of manufacturing, assembling, operating, use, etc.) may consist of certain preferred steps and components as explained herein, not all of these steps and components are essential to the invention and thus should not be taken in their restrictive sense, i.e. should not be taken as to limit the scope of the present invention. It is to be understood, as also apparent to a person skilled in the art, that other suitable steps, components and cooperation thereinbetween, may be used for the present drag-reducing method of a bullet and corresponding bullet (as well as corresponding components thereof) according to the present invention, as will be briefly explained hereinafter and as can be easily inferred herefrom by a person skilled in the art, without departing from the scope of the invention.

Broadly described, the present invention, as illustrated in the accompanying drawings, relates to a new and improved bullet, typically for use with a cartridge for propulsion out of a barrel of a weapon, such as rifles and the like, the bullet comprising a) a main body acting as a projectile, and b) a drag-reducing assembly provided about the main body, and configured for being triggered upon a blast from the cartridge, in order to reduce a resulting drag of the projectile during flight trajectory, thereby improving resulting ballistic performance of the bullet.

According to a first possible embodiment of the present invention (referred to as "passive boost bullet" or "generation 1", for example, in the context of the present description), and as can be easily understood when referring to FIG. 1, the bullet 1 contains features that help to increase ballistic performance.

The bullet 1 has a longitudinal axis 17, and opposed forward 2 and rearward 4 ends. The bullet 1 further comprises a main body 3 acting as a projectile, the main body 3 being substantially ogive-shaped towards the forward end 2. The main body 3 comprises a length l, a frontward section 3*a* at the forward end 2 of the bullet 1, a rearward section 3*b* at the rearward end 4 of the bullet 1, and a central section 3*c* arranged between the frontward and rearward sections 3*a*, 3*b*. The bullet 1 further comprises a drag-reducing assembly 5.

The drag-reducing assembly 5 comprises an internal body cavity 7 provided in the shown embodiment in the rearward section 3*b* of the main body 3; the internal body cavity 7 has an open face 8 at the rearward end 4 of the bullet 1. In other words, the internal body cavity 7 opens outwardly at the rearward end 4 of the bullet 1. In the shown embodiment, the internal body cavity 7 is substantially cylindrical and has an outer diameter $d_1$ and a length $l_1$. The main body 3 has an outer diameter $d_2$, the outer diameter $d_1$ of the internal body cavity 7 being smaller than the outer diameter $d_2$ of the main body 3. The drag-reducing assembly 5 further comprises a choking annulus 11 (or nozzle component) comprising an inner diameter $d_3$, an outer diameter $d_4$ and a length 12. In the shown embodiment, the inner diameter $d_3$ of the choking annulus 11 is smaller than the outer diameter $d_1$ of the internal body cavity 7, and the choking annulus 11 is at least partially arranged in the internal body cavity 7. The choking annulus 11 comprises an inner volume that is in fluid communication with the internal body cavity 7. The choking annulus 11 is mounted to the rearward section 3*b* of the main body 3, for instance in the internal body cavity 7 at least partially formed in the rearward section 3*b* of the main body 3. For instance, the choking annulus 11 and the internal body cavity 7 cooperate together using a screw thread. For instance, a threading 13 is formed on an outer surface of the choking annulus 11 and is configured to cooperate with a threading formed on an inner surface of the internal body cavity 7. For instance, the threading is formed in a direction opposite of rotational direction of the bullet 1 during its flight. In other embodiments, the choking annulus 11 is press-fitted into the internal body cavity 7 or the choking annulus 11 is bonded to the inner surface of the internal body cavity 7. In these embodiments, for instance, the outer diameter $d_4$ of the choking annulus 11 is greater than the outer diameter $d_1$ of the internal body cavity 7, for the choking annulus 11 to be snugly fitted in the internal body cavity 7.

As represented on FIG. 1, the internal body cavity 7 opens at the rearward end 4 of the bullet 1. It is understood that the open face 8 of the internal body cavity 7 defines an orifice or opening 9 at the rearward end 4 of the bullet 1 that is configured, as detailed below, for a fluid to pass. In other words, the open face 8 of the internal body cavity 7 defines a fluid passage 15 in the bullet 1. In other words, as represented for instance on FIG. 1, the bullet 1 has a base 22 opposed to the ogive-shaped portion 21, a cavity being formed in the bullet 1 that opens in its base 22. The choking annulus 11 is mounted in the internal body cavity 7 and partially defines the base of the bullet 1.

It is clear from the present description that the drag-reducing assembly 5 is not necessarily distinct from the main body 3 of the bullet 1. In other words, the drag-reducing assembly 5 can comprise elements from the main body 3. For instance, it is understood that the internal body cavity 7 is provided in the main body 3. In the shown embodiment, the internal body cavity 7 is formed in the rearward section 3*b* of the main body 3, and is in fluid communication with the orifice or opening 9 that is also provided in the rearward section 3*b*. The choking annulus 11 (or nozzle component) is mounted at least partially in the opening 9, and has a through opening in fluid communication with the internal body cavity 7 provided in the main body 3.

It is understood that the bullet 1 as represented in FIG. 1 is configured so that: a) during firing, combustion gas fills the internal body cavity 7 of the bullet 1; b) as the bullet travels, the gas will continue to expand and the bullet accelerates; and c) the gas can eject through the choke annulus 11, for example, and provide a pressure relief behind the rearward end 4 of the bullet.

Indeed, the present invention relates to performance enhancements of a bullet. As previously explained, conventional bullets are affected by a pressure difference that occurs on the rearward face. This drop in pressure causes drag and can generate flight instability. These factors will reduce the precision and accuracy of a bullet grouping. The present first embodiment of the present invention is particularly advantageous in that it does not use secondary combustion methods to mitigate the pressure difference, and the rearward face can still maintain perpendicularity of a conventional bullet geometry.

As can be easily understood when referring to FIG. 1, for example, this particular first embodiment of the present invention is directed to using an internal body cavity to capture gun gas during combustion. To reduce the base drag of a projectile, gun gases are leaked that had been accumulated in the rear of the projectile. The gun gases can be leaked through a choke annulus, for example, from the internal body cavity to the outside of the projectile. This can improve a bullet's structural integrity, gyroscopic stability and/or cargo carrying capabilities by usage of multitude of materials in design of the bullet.

According to this particular first embodiment of the present system, during a firing of the bullet, the following events and/or associated advantages can occur:

1) propellant is ignited in the chamber of the gun—gun gas generated thus acts on the base of the projectile;
2) the gun gas pushes the projectile forward in the barrel and at the same time enters the internal body cavity 7 located at the rearward end 4 of the projectile 1;
3) at the emergence of the projectile out of the barrel gun, gases momentarily bypass the projectile and at the same time still act on the base of the projectile;

4) the pressure inside of the internal body cavity 7 of the projectile is higher than the pressure outside of the projectile and gun gas accumulated in the rear (or internal body) cavity is discharged to the outside; and
5) the gun gas thereby released from the cavity fills a partial vacuum behind the projectile and thus reduces the base drag (i.e. reduces the drag that would normally be generated behind the base of a conventional bullet, etc.).

As described above with reference to FIG. 1, the first embodiment of the present bullet system may come in the form of a bullet including one and/or several of the following optional components and features (and/or different possible combination(s) and/or permutation(s) thereof):

a) option 1: a passive boost bullet comprising: a bullet having a forward 2 and rearward 4 end; an internal body cavity 7 towards the rearward end of the bullet; and a choke annulus (or nozzle component); wherein said choke annulus is attached within the rearward end;
b) option 2: the internal body cavity of option 1 has an open face 8 at the rearward end of the bullet—the outer diameter of said internal body cavity is smaller than the outer diameter of a main body 3 of the bullet;
c) option 3: a choke annulus 11 comprising of an outer diameter and inner diameter and length;
d) option 4: the choke annulus is attached to said rearward end of the bullet using a screw thread, press-fit or otherwise bonded;
e) option 5: the orientation of said threading in option 4 is opposite of rotational direction of bullet during flight—the threading is present on the outer diameter of the choke annulus in option 3 and mating threading is present on the inner diameter of said internal body cavity in option 2; and
f) option 6: the choke annulus can be press-fitted into said internal body cavity 7 using an interference fit—the outer diameter of said choke annulus in option 4 is larger than the inner diameter of said internal body cavity in option 2.

Figure 5:
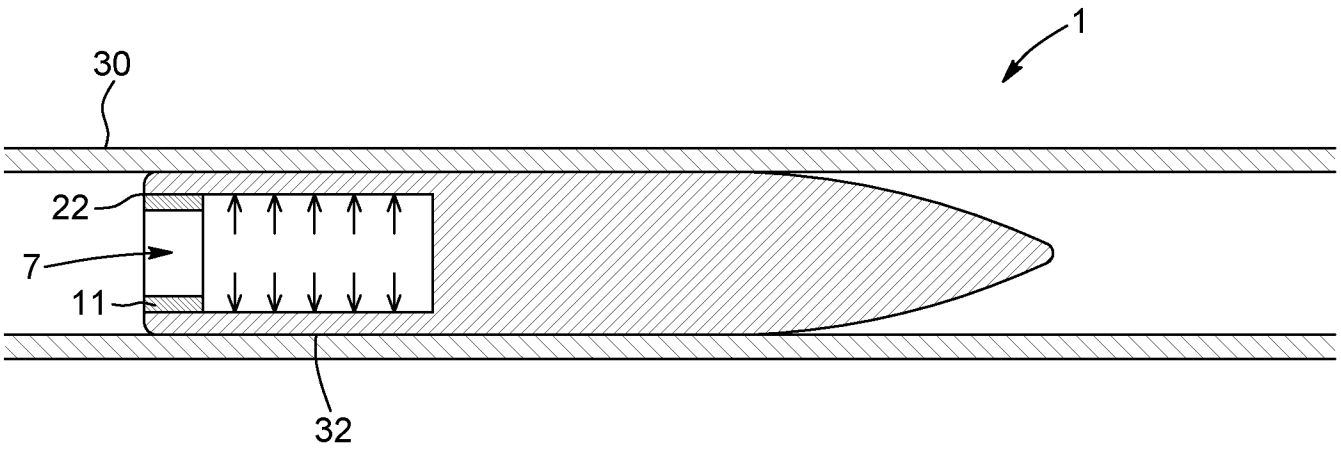
FIG. 5 is a schematic cross-sectional representation of a bullet being shown inside a barrel according to a possible embodiment of the present invention.

As represented in particular in FIG. 5, the drag-reducing assembly 5 of the bullet 1 is also configured to improve the obturation of gun gas between a barrel 30 of a weapon in which the bullet 1 is arranged, and the bullet 1. Indeed, when gas is captured in the internal body cavity 7, as schematically represented on FIG. 5 by the vertical arrows, a pressure is exerted from the inner volume of the internal body cavity 7 that provides a radially expansion of the bullet 1 and thus improves the peripheral cooperation between the bullet 1 and an inner surface of the barrel 30. In other words, a cooperation surface 32 is formed between the bullet 1 and the inner surface of the barrel. The obturation of gas in the barrel 30 is thus further improved. Moreover, the drag-reducing assembly 5 also provides structural support for the bullet 1 to withstand the maximum translational and rotational acceleration while the bullet 1 is in the barrel 30. The drag-reducing assembly 5 also ensures structural integrity of the bullet 1 upon its exit out of the barrel 30 while the bullet 1 is subjected to negative acceleration and maximum rotational velocity.

Figure 6B:
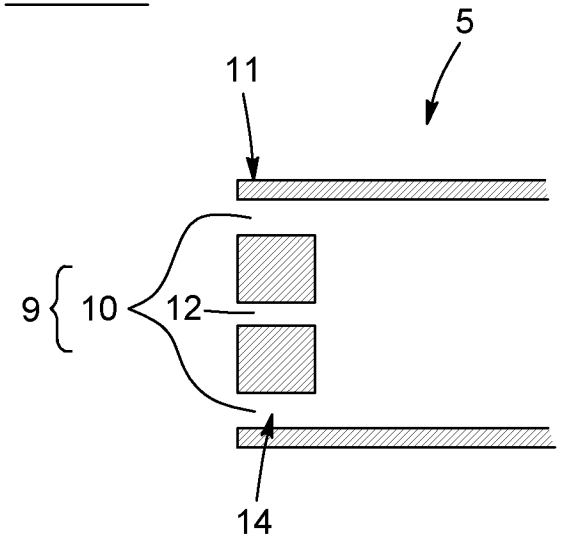
FIGS. 6A and 6B are respectively a rear view and a schematic cross-sectional representation of a drag-reducing assembly according to a possible embodiment of the present invention.
Figure 6A:
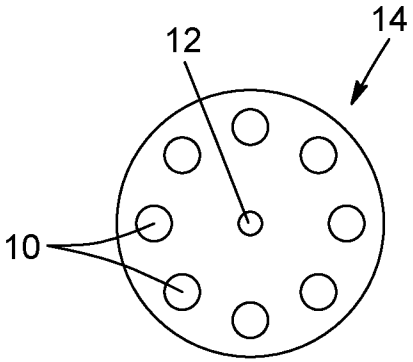

As mentioned above, the open face 8 of the internal body cavity 7 forms an orifice or opening 9 at the rearward end 4 of the bullet 1. In the embodiment represented in FIG. 1, the rim of the orifice 9 is defined by the choking annulus 11. Thus, in this embodiment, the bullet 1 has a single fluid passage 15 defined by the orifice 9 and delimited by the choking annulus 11. As represented on FIGS. 6A and 6B, other shapes and dimensions of the orifice 9 could be conceived without going beyond the ambit of the present disclosure. In the shown embodiment in FIGS. 6A and 6B, the drag-reducing assembly 5 of the bullet 1 further comprises a perforated cap 14, the cap 14 being, for instance, mounted to an inner surface of the choking annulus 11. The perforated cap 14 comprises, for instance, a central opening 12 and a series of peripheral holes 10 forming together a plurality of orifices 9 defining a plurality of fluid passages 15.

Figure 2:
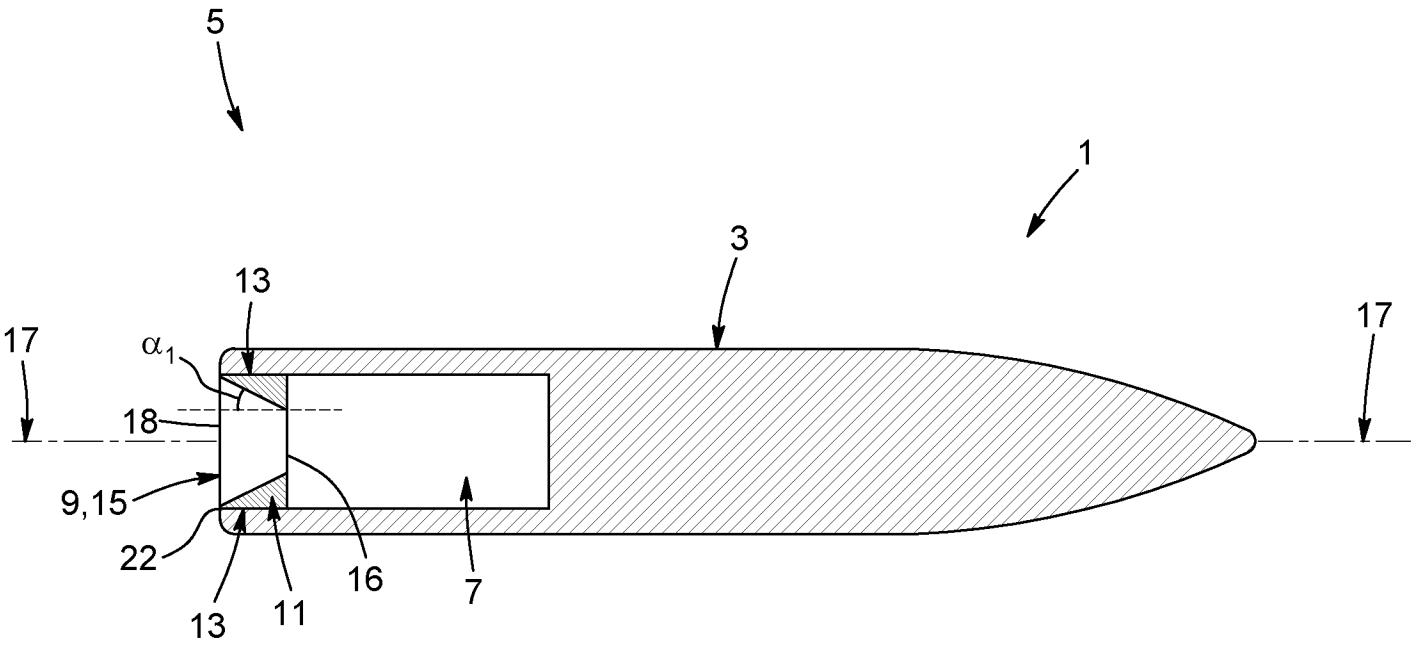
FIG. 2 is a schematic cross-sectional representation of a bullet according to another possible embodiment of the present invention, referred to herein also as "active boost bullet" or "generation 2".

According to a second possible embodiment of the present invention (referred to as "active boost bullet" or "generation 2", for example, in the context of the present description), and as can be easily understood when referring to FIG. 2, the bullet 1 also contains similar features that help to increase ballistic performance.

The bullet 1 comprises a main body 3 and a drag-reducing assembly 5. The drag-reducing assembly 5 comprises a substantially cylindrical internal body cavity 7 and a nozzle component 11. The same structural, arrangement and dimensional considerations as the ones detailed above with reference to FIG. 1 and to the choking annulus 11 also apply to the nozzle component 11 of this further embodiment of a bullet 1 according to the present disclosure. The nozzle component 11 is arranged at the rearward end 4 of the bullet 1, and is mounted to an end of the internal body cavity 7. For instance, a threading 13 is formed on an outer surface of the nozzle component 11, that is configured to cooperate with another threading formed on an inner surface of the internal body cavity 7. The nozzle component 11 has an inner diameter $d_3$, an outer diameter $d_4$, and opposed inlet 16 and outlet 18 faces. It is understood that the inlet face 16 is arranged closer to the forward end 2 of the bullet 1 than the outlet face 18. The inlet face 16 is configured to cooperate to an end of the internal body cavity 7. A through opening is formed in the nozzle component 11 that extends between the inlet and outlet faces 16, 18. The through opening of the nozzle component 11 is in fluid communication with the internal body cavity 7. The inlet and outlet faces 16, 18 both have an aperture, for instance circular, the dimensions of the aperture that is formed in the inlet face 16 being smaller than the dimensions of the aperture that is formed in the outlet face 18. In other words, the dimensions of the section of the through opening that is formed in the nozzle component 11 increase from the outlet face 18 towards the inlet face 16. As represented in FIG. 2, the nozzle component 11 defines a divergence angle $\alpha_1$ towards the rearward end 4 of the bullet 1. In an embodiment, the divergence angle $\alpha_1$ is comprised between 10 degrees and 70 degrees. In another embodiment, the divergence angle $\alpha_1$ is comprised between 15 degrees and 60 degrees. In another embodiment, the divergence angle $\alpha_1$ is about 30 degrees. As represented on FIG. 2, the internal body cavity 7 opens at the rearward end 4 of the bullet 1. It is understood that the open face 8 of the internal body cavity 7 forms an orifice 9 (or opening) at the rearward end 4 of the bullet 1 that is configured, as detailed below, for a fluid to pass. In other words, the open face 8 defines a fluid passage 15.

As for the embodiment described with reference to FIG. 1, the bullet 1 of FIG. 2 could also comprise a perforated cap 14. In other words, as represented for instance on FIG. 2, the bullet 1 has a base 22 opposed to the ogive-shaped portion 21, a cavity being formed in the bullet 1 that opens in its base 22. The nozzle component 11 is mounted in the internal body cavity 7 and partially defines the base of the bullet 1.

It is clear from the present description that the drag-reducing assembly 5 can comprise elements from the main body 3. For instance, it is understood that the internal body cavity 7 is provided in the main body 3. In the shown embodiment in FIG. 2, the internal body cavity 7 is formed in the rearward section 3*b* of the main body 3, and is in fluid communication with the orifice or opening 9 that is also provided in the rearward section 3*b*. The nozzle component 11 is mounted at least partially in the opening 9, and has a through opening in fluid communication with the internal body cavity 7 provided in the main body 3.

It is understood that the bullet 1 as represented in FIG. 2 is configured so that: a) the bullet 1 contains an internal body cavity 7 that can contain propellant; b) during firing, combustion gas pushes the bullet as well as triggers ignition of internal propellant; c) as the bullet travels, the gas will continue to expand due to the burning of propellant internal to the bullet and the bullet accelerates; and d) the gas will eject through the nozzle component 11—and more particularly through the outlet face 18 of the nozzle component 11—and provide a pressure relief behind the rearward face of the bullet.

Indeed, the present invention relates to performance enhancements of a bullet. As previously explained, conventional bullets are affected by a pressure difference that occurs on the rearward face. This drop in pressure causes drag and can generate flight instability. These factors will reduce the precision and accuracy of a bullet grouping. This present second embodiment of the present invention is particularly advantageous in that it does not use secondary combustion methods to mitigate the pressure difference. Also, there are at least three main advantages resulting from the features detailed in regards this particular second embodiment of the present invention. Firstly, to increase the muzzle velocity of the projectile by burning propellant located in the internal body cavity of the projectile, in addition to the propellant that is in the cartridge case of the round. The burning of the propellant in the projectile will extend the pressure in the barrel resulting in higher muzzle velocity of the projectile. Secondly, the base drag reduction will be more effective as the differential of pressure between internal body cavity and outside of the projectile will be higher than in case of absence of propellant in the cavity. Thirdly, thrust upon exit from the muzzle will result in higher velocity of the projectile. Furthermore, the rearward face of this particular embodiment can still maintain perpendicularity of a conventional bullet geometry.

As can be easily understood when referring to FIG. 2, for example, this particular second embodiment of the present invention is directed to using an internal body cavity 7 to store additional propellant. The extra stored propellant can result in the following advantages: a higher muzzle velocity for the same weight of projectile without an increase in breech pressure, a base aerodynamic reduction during flight and/or a shorter time of flight to target.

According to this particular second embodiment of the present system, during a firing of the bullet, the following events and/or associated advantages can occur:

1) propellant in the cartridge is ignited and generates gun gas that exerts pressure on the base of the projectile;
2) the gun gas pushes the projectile forward in the barrel and gun gas enters into the internal body cavity 7 igniting the additional propellant (ex. gun powder, etc.)—the ignition of the propellant in the cavity while the projectile is in motion creates effect of "travelling charge"—the effect of "travelling charge" is that the pressure on projectile base during projectile motion in the barrel is higher than that of a fixed charge;
3) the higher pressure on the base of the projectile while the projectile is in the barrel results in turn in a higher muzzle velocity of the projectile;
4) at the emergence of the projectile out of the barrel, the burning gun gas escapes out from the cavity of the projectile resulting in a thrust; and
5) as the pressure in the cavity diminishes, the gas discharge diminishes but the effect of the base drag reduction is still in effect.

The second embodiment of the present bullet system may come in the form of a bullet including one and/or several of the following optional components and features (and/or different possible combination(s) and/or permutation(s) thereof):

a) option 1: an active boost bullet comprising: a bullet having a forward and rearward end; an internal body cavity towards the rearward end of the bullet; and a nozzle component 11; wherein said nozzle component 11 is attached within the rearward end or is integrated to the rearward end of the bullet;
b) option 2: a nozzle component composed of an inner diameter and divergence angle $\alpha_1$ up to 30 degrees—the nozzle has an inlet face 16 and an outlet face 18—the inlet face of the nozzle has an aperture smaller than the aperture on the outlet face;
c) option 3: the nozzle component described in option 2 may be a separate component that is threaded, press-fitted or otherwise bonded to the main body of the bullet;
d) option 4: the nozzle component in option 2 may be an integral feature to the bullet and not constitute a separate component—the nozzle and the main body of the bullet would be joined between their outer diameter and inner diameter respectively;
e) option 5: the internal body cavity 7 of option 1 has an open face at the rearward end of the bullet and terminates at the inlet face of the nozzle component as described in option 2—the outer diameter of said internal body cavity is smaller than the outer diameter of the bullet—the cavity will contain propellant;
f) option 6: the orientation of said threading 13 in option 3 is opposite of rotational direction of bullet during flight—the threading is present on the outer diameter of the nozzle component in option 2 and mating threading is present on the inner diameter of said internal body cavity 7 in option 5; and
g) option 7: the nozzle component 11 can be press-fitted into said internal body cavity 7 using an interference fit—the outer diameter of said nozzle component 11 in option 2 is larger than the inner diameter of said internal body cavity in option 5.

Figure 3:
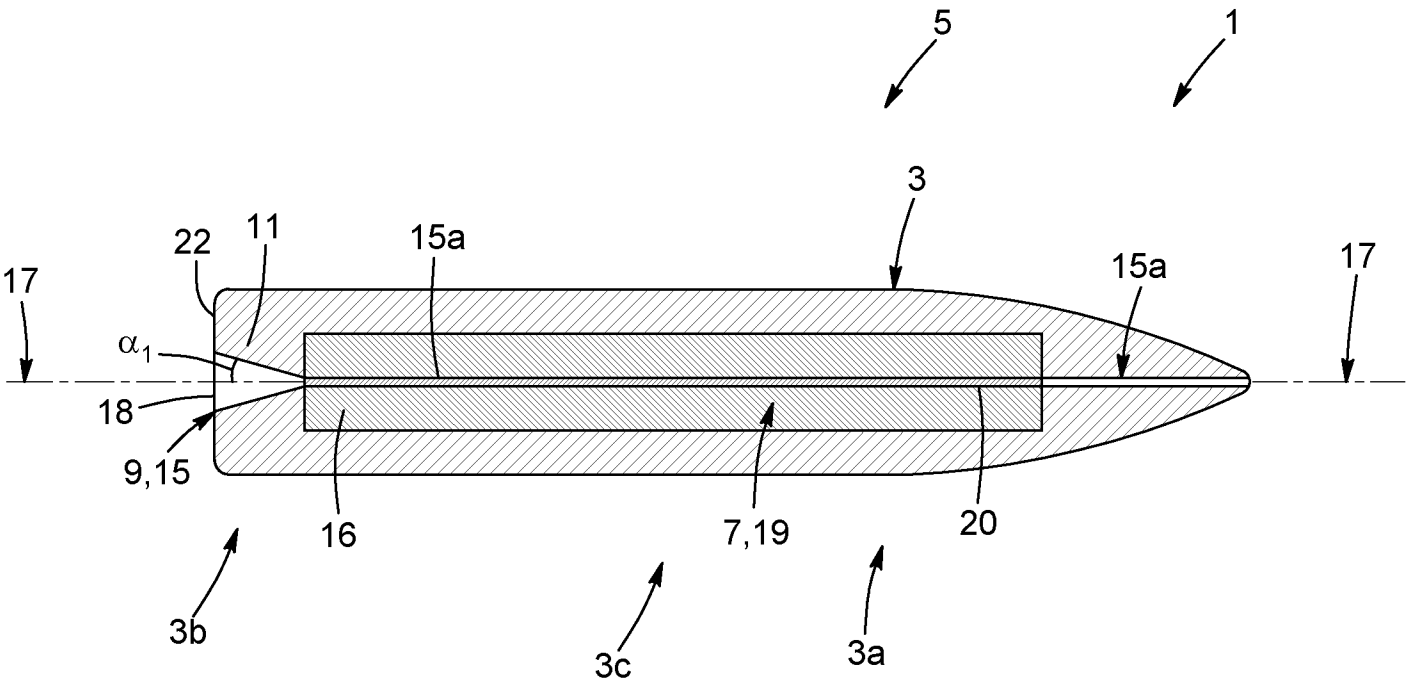
FIG. 3 is a schematic cross-sectional representation of a bullet according to yet another possible embodiment of the present invention, referred to herein also as "phase change boost bullet" or "generation 3".

According to a third possible embodiment of the present invention (referred to as "phase change boost bullet" or "generation 3", for example, in the context of the present description), and as can be easily understood when referring to FIG. 3, the bullet also contains similar features that help to increase ballistic performance.

The drag-reducing assembly 5 of the bullet 1 comprises an internal body cavity 7 formed in the main body 3. For instance, the internal body cavity 7 has a substantially cylindrical shape and is formed between the forward and rearward ends 2, 4 of the bullet 1. The drag-reducing assembly 5 further comprises an axial cavity 15*a* extending substantially along the longitudinal axis 17 of the bullet 1. As represented in FIG. 3, the axial cavity 15*a* extends in the internal body cavity 7 and further extends in the frontward section 3*a* of the main body 3. The axial cavity 15*a* opens outwardly at the forward end 2 of the bullet 1. A membrane 20 delimits the axial cavity 15*a* in the internal body cavity 7. In other words, the membrane 20 forms a barrier between the axial cavity 15*a* and the internal body cavity 7. The drag-reducing assembly 5 also comprises a nozzle component 11 arranged between the internal body cavity 7 and the rearward end 4 of the bullet 1. As described with regard to FIG. 2, the nozzle component 11 has an inlet face 16, an outlet face 18, the inlet face 16 having an aperture smaller than the one formed in the outlet face 18. A through opening is formed in the nozzle component 11 that extends between the outlet and inlet faces 18, 16. The through opening of the nozzle component 11 is in fluid communication with the axial cavity 15*a*. In the shown embodiment, it is thus understood that a fluid passage is formed between the forward end 2 and the rearward end 4 of the bullet 1, the fluid passage being defined successively by the nozzle component and the axial cavity. As represented in FIG. 3, the nozzle component 11 defines a divergence angle $\alpha_1$ towards the rearward end 4 of the bullet 1. In an embodiment, the divergence angle $\alpha_1$ is comprised between 10 degrees and 70 degrees. In another embodiment, the divergence angle $\alpha_1$ is comprised between 15 degrees and 60 degrees. In another embodiment, the divergence angle $\alpha_1$ is about 30 degrees.

It is understood that the bullet 1 as represented in FIG. 3 is configured so that: a) the bullet contains an internal body cavity 7 that contains propellant; b) during firing, combustion gas pushes the bullet as well as triggers an ignition of internal propellant; c) as the bullet travels, the gas will continue to expand due to the burning of the propellant internal to the bullet and the bullet accelerates; and d) the gas will eject through the nozzle component 11 and provide a pressure relief behind the rearward face of the bullet.

Indeed, the present invention relates to performance enhancements of a bullet. As previously explained, conventional bullets are affected by a pressure difference that occurs on the rearward face. This drop in pressure causes drag and can generate flight instability. These factors will reduce the precision and accuracy of a bullet grouping. The present third embodiment of the present invention, namely the "phase change boost bullet", uses the gun gases of the burning propellant as a catalyst to change the state of a substance from "liquid" to "vapour" (for example, although "solid" to "vapour" could also be contemplated, etc.). The change of state of a substance will substantially increase the volume of the substance and the pressure in which the substance is contained. The vapour generated by change of state is then released outside of the projectile—as the vapour has a lesser density and viscosity than the surrounding air, the aerodynamic drag will decrease as compared to a drag generated by a projectile flying through the air.

As can be easily understood when referring to FIG. 3, for example, for this particular third embodiment of the present invention, during a bullet firing sequence, ignition of the propellant in the gun chamber generates gun gas. The gas pushes on the base 22 of the projectile—some of the gas enters into the nozzle component 11, pushes the air in front of the projectile and exits through the tip 21 of the nose of the projectile. The projectile moves forward in the barrel 30 with small air resistance in front. As the hot gun gas passes through the tube (or axial cavity 15*a*) joining the nozzle component 11 with the tip of the ogive, it heats up the container defined by the internal body cavity 7 with the liquid. The liquid evaporates and vapour is discharged into the axial cavity 15*a*, for example, right after projectile exits the barrel. Upon the emergence of the projectile from the muzzle, the gun gas and the vapour push the air in front of the projectile. The vapour continuous discharge from the nose of the projectile engulfs the body of the projectile reducing frontal, skin and/or base drag of the projectile.

It is clear from the present description that the drag-reducing assembly 5 is not necessarily distinct from the main body 3 of the bullet 1. In other words, the drag-reducing assembly 5 can comprise elements from the main body 3. For instance, it is understood that the internal body cavity 7 and the axial cavity 15*a* are provided in the main body 3. In the shown embodiment, the internal body cavity 7 is formed in the rearward and central sections 3*b*, 3*c* of the main body 3, and is in fluid communication with the orifice or opening 9 that is provided in the rearward section 3*b*. The axial cavity 15*a* is formed in the main body 3 and extends in the rearward, central and forward sections 3*b*, 3*c*, 3*a*. The nozzle component 11 is mounted at least partially in the opening 9 that is in fluid communication with the axial cavity 15*a* and the internal body cavity 3. The nozzle component 11 has a through opening in fluid communication with the internal body cavity 7 and with the axial cavity 15*a*.

According to this particular third embodiment, during a firing of the bullet, the following events and/or associated advantages can occur:

1) gun gas is used as a catalyst in change of state of a substance from liquid to vapour;
2) the vapour reduces the base drag and/or skin friction of a projectile;
3) the vapour of a substance ejected outside of a projectile reduces frontal drag of a projectile;
4) the substance ejected outside of a projectile is used to reduce the Magnus forces on a projectile; and
5) reduction of the aerodynamic drag and Magnus effect results in shorter time of flight, better accuracy and dispersion.

The third embodiment of the present bullet system may come in the form of a bullet including one and/or several of the following optional components and features (and/or different possible combination(s) and/or permutation(s) thereof):

a) option 1: a phase change boost bullet comprising: a bullet having a forward and rearward end; an internal body cavity 7; a nozzle component 11; a membrane 20 between the internal body cavity 7 and an axial cavity 15*a* that runs from the forward to rearward ends of the bullet;
b) option 2: a nozzle component composed of an inner diameter and divergence angle up to 30 degrees—the nozzle component has an inlet face 16 and an outlet face 18—the inlet face of the nozzle component has an aperture smaller than the aperture on the outlet face;
c) option 3: the nozzle component described in option 2 may be a separate component that is threaded, press-fitted or otherwise bonded to the bullet;
d) option 4: an axial cavity 15*a* runs from the forward end to rearward end of the bullet—this axial cavity has an outer diameter that is not smaller than the dimensions of the aperture formed in the inlet face 16 of said nozzle component detailed in option 2;
e) option 5: the nozzle component 11 in option 2 may be an integral feature to the bullet and not constitute a separate component—the nozzle and the main body 3 of the bullet 1 would be joined between their outer diameter and inner diameter respectively;
f) option 6: a membrane 20 functions as a barrier between the axial cavity 15*a* and the internal body cavity 7—this membrane has channels that allow gun gas to excite the fluid inside the internal body cavity to the point of phase change—the gas will exit the bullet through the nozzle and axial cavity;

g) option 7: said membrane 20 detailed in option 6 can also be ablative and degrade during exposure to gun gas—without the membrane the effects of the phase change will exit through the nozzle and axial cavity;

h) option 8: the internal body cavity 7 of option 1 has an outer diameter smaller than the outer diameter of the main body of the bullet—the internal body cavity is filled with a fluid; and i) option 9: the orientation of said threading in option 3 is opposite of rotational direction of bullet during flight.

Figure 4:
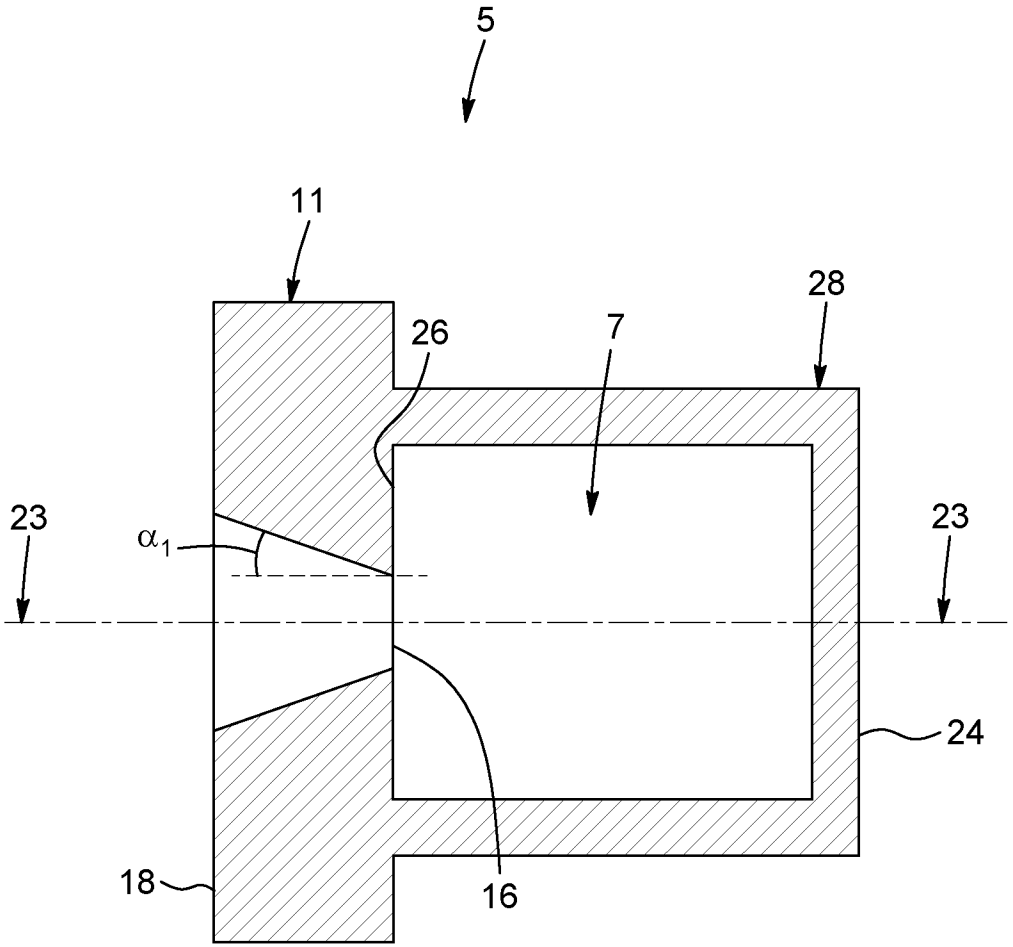
FIG. 4 is a schematic cross-sectional representation of a bullet according to yet another possible embodiment of the present invention, referred to herein also as "additive manufactured bullet nozzle" or "generation 4".

According to a fourth possible embodiment of the present invention (referred to as "additive manufactured bullet nozzle" or "generation 4", for example, in the context of the present description), and as can be easily understood when referring to FIG. 4, the bullet also contains similar features that help to increase ballistic performance.

As represented in FIG. 4, the drag-reducing assembly 5 has a longitudinal axis 23 and comprises a nozzle component 11 and a body portion 28 in which is formed an internal body cavity 7. The nozzle component 11 and the body portion 28 in which the internal body cavity 7 is formed form together one single element that is manufactured, for instance, by using an additive manufacturing process. As in the embodiments represented in FIGS. 2 and 3, the nozzle component 11 has an inlet face 16 and an outlet face 18, the inlet face 16 having an aperture that is smaller than an aperture that is formed in the outlet face 16. A through opening is formed in the nozzle component 11 that extends between the inlet and outlet faces 16, 18. The through opening of the nozzle component 11 is in fluid communication with the internal body cavity 7 that is formed in the body portion 28. Moreover, the nozzle component 11 defines a divergence angle $\alpha_1$ towards the inlet face 16. In an embodiment, the divergence angle $\alpha_1$ is comprised between 10 degrees and 70 degrees. In another embodiment, the divergence angle $\alpha_1$ is comprised between 20 degrees and 60 degrees. In another embodiment, the divergence angle $\alpha_1$ is about 45 degrees. The body portion 28 in which the internal body cavity 7 is formed comprises a rearward end 26 that mates the inlet face 16 of the nozzle component 11, and an opposed forward end 24.

It is understood that the drag-reducing assembly 5 as represented in FIG. 4 is configured so that: a) the bullet in which the drag-reducing assembly 5 is mounted can be further modified to increase its ballistic performance; b) the inclusion of a cavity to provide suspended gas escape and/or as a storage for additional propellant can be used to increase muzzle velocity of a bullet without increasing the breech pressure; c) in order to benefit from an internal bullet cavity, a reduction of cross-sectional area in flow should be present; d) this feature is commonly referred to as a "choke" or "nozzle"; e) the nozzle component will provide means to regulate gas flow and assist in the ballistic performance of a bullet; f) due to the feature placement, the nozzle component should be ideally fabricated through means of "additive manufacture", in that, it is very difficult or even impossible to use conventional subtractive machining to fabricate the components and/or features detailed in the present description and/or accompanying drawings.

Indeed, the present invention relates to performance enhancements of a bullet. As previously explained, conventional bullets are affected by a pressure difference that occurs on the rearward face. This drop in pressure causes drag and can generate flight instability. These factors will reduce the precision and accuracy of a bullet grouping. The present fourth embodiment of the present invention relates to a structure that can increase ballistic performance—namely, by integrating an enclosed cavity and nozzle component as a single structure, a reduction of drag can be achieved. It is not possible to fabricate the additive manufactured bullet nozzle using subtractive methods as there are features in the component that tooling cannot reach. Through the process of additive manufacture, the entire drag-reducing assembly can be fabricated without the use of secondary joining processes such as brazing or welding, for example.

As can be easily understood when referring to FIG. 4, for example, this particular fourth embodiment of the present invention is directed to using an internal body cavity to store additional propellant. The extra stored propellant will result in the following advantages: a higher muzzle velocity for the same weight of projectile without an increase in breech pressure, a base aerodynamic reduction during flight and/or a shorter time of flight to target.

According to this particular fourth embodiment, during a firing of the bullet (and/or prior thereto), the following events and/or associated advantages can occur:

1) the cavity section of the additive manufactured bullet nozzle can remain empty to facilitate gas expansion or can be packed with additional propellant;

2) if the enclosed cavity contains propellant, this additional propellant will ignite and function as a rocket motor—expanding gas will thus be forced through the nozzle orifice; and 3) if the enclosed cavity does not contain propellant, the cavity will be filled with expanding gun gas—escaping gun gas will reduce drag effects of the bullet in flight.

The fourth embodiment of the present bullet system may come in the form of a bullet including one and/or several of the following possible components and features (and/or different possible combination(s) and/or permutation(s) thereof):

a) option 1: an additive manufactured bullet drag-reducing assembly 5 comprising: a nozzle component and a body portion having an enclosed internal body cavity as a single component;

b) option 2: a nozzle component composed of an inner diameter and divergence angle up to 45 degrees—the nozzle component has an inlet face and an outlet face—the inlet face of the nozzle component has an aperture smaller than the aperture on the outlet face;

c) option 3: an enclosed cavity formed in the body portion that has two ends—the rearward end mates to the inlet face of the nozzle described in option 2—the enclosed cavity has an outer diameter, inner diameter and a length;

d) option 4: said additive manufactured bullet drag-reducing assembly is detailed in option 1 is fabricated through the use of additive manufacture—additive manufacture includes "material jetting", "binder jetting", "powder bed fusion", "sheet lamination" and all forms of manufacturing that does not involve material subtractive operations; and e) option 5: said additive manufactured bullet drag-reducing assembly detailed in option 1 can be inserted into the bullet through means of screw-threading, press-fitting, bonded or by other means—if the additive manufactured bullet nozzle is screw threaded to the inner diameter of a compliant cavity in the bullet, the threading direction is opposite to the direction of rotation of flight.

As this is apparent from the above description, the bullet 1 according to the different embodiments of the present disclosure consists of more than one component. For instance, all or part of the bullet 1 is manufactured using an additive manufacturing process. Additive manufacturing affords in particular design and fabrication methods which can hardly be achieved via traditional subtractive operations. The accuracy of the shapes and dimensions of the different components of the bullet 1 can be improved via additive manufacturing. Moreover, the mass distribution of the structure of the bullet according to the present disclosure can be improved: it is known that the bullet 1 is subjected to maximum "g" loading and therefore should have material with a high yield point in a strategically engineering location. Optimization can lead to a weight reduction as to minimize the traverse moment of inertia resulting in an increase of the gyroscopic stability. Furthermore, the internal body cavity 7 should be capable of withstanding high internal pressures and centripetal forces to contain hot gases during the flight of the bullet 1. The outer surface of the bullet 1 also has to engrave into the barrel rifling and have high malleable properties and high density to maximize the axial moment of inertia and weight of the bullet 1. To maximize the penetration upon impact high hardness and toughness of material are also required. The additive manufacturing process is particularly well suited for production of bullets with complex geometries without incurring assembly costs. Moreover, additive manufacturing makes it possible to use different material, each material having properties that are adapted to the function of the component it forms. In other words, additive manufacturing is particularly well adapted to the manufacturing of the bullet according to the present disclosure. The complexity for assembling the different small components of the bullet is eliminated by using additive manufacturing technology.

LIST OF MAIN NUMERICAL REFERENCES FOR SOME OF THE CORRESPONDING POSSIBLE COMPONENTS ILLUSTRATED IN THE ACCOMPANYING DRAWINGS

1. bullet (or Nemesis Bullet™ or simply "Nemesis")
2. forward end
3. main body (of bullet)
3*a*. frontward section (of main body)
3*b*. rearward section (of main body)
3*c*. central section (of main body)
4. rearward end
5. drag-reducing assembly
7. internal body cavity
8. open face
9. orifice
11. nozzle component (ex. choking annulus)
13. threading
14. cap
15. fluid passage
15*a*. axial cavity
16. inlet face
17. longitudinal axis (of bullet)
18. outlet face
19. propellant (ex. additional propellant inside cavity)
20. membrane
21. ogive-shaped portion (of bullet)
22. base
23. longitudinal axis (of nozzle component)
28. body portion Indeed, the present bullet is particularly advantageous in that, by virtue of its design, components and features, as better described and illustrated herein, it enables to fire a projectile (ex. a bullet, etc.) in a more efficient, more precise, more accurate, more reliable, more adjustable, more versatile, more adaptable, more impactful, more strategic, more powerful, more lethal and/or more desirable manner (ex. depending on the circumstances, and the intended results, etc.). As previously explained, and depending on the different possible embodiments, the present system also advantageously enables to: a) improve a bullet's structural integrity; b) improve gyroscopic stability; c) improve cargo carrying capabilities; d) a higher muzzle velocity for the same weight of projectile without an increase in breech pressure; e) a base aerodynamic reduction during flight; f) a shorter time of flight to target; and/or etc.

The present bullet 1 may come in the form of a bullet including one and/or several of the following possible components and features (and/or different possible combination(s) and/or permutation(s) thereof):

i) A bullet for use with a cartridge for propulsion out of a barrel of a weapon, the bullet comprising:

a main body acting as a projectile; and a drag-reducing assembly provided about the main body, and configured for being triggered upon a blast from the cartridge, in order to reduce a resulting drag of the projectile during flight trajectory, thereby improving resulting ballistic performance of the bullet.

ii) A bullet according to any one of the preceding combination(s), wherein the bullet comprises at least one cavity disposed about (ex. on, in, inside, through, along and/or any other suitable disposition) about a portion of the main body, and being configured for receiving a portion of gun gas from the cartridge (and/or cartridge blast).

iii) A bullet according to any one of the preceding combination(s), wherein the at least one cavity includes at least one cavity external to the main body of the bullet.

iv) A bullet according to any one of the preceding combination(s), wherein the at least one cavity includes at least one cavity internal to the main body of the bullet.

v) A bullet according to any one of the preceding combination(s), wherein the at least one cavity includes at least one cavity being both external and internal to the main body of the bullet.

vi) A bullet according to any one of the preceding combination(s), wherein the at least one cavity includes at least one cavity disposed about a rearward section of the bullet.

vii) A bullet according to any one of the preceding combination(s), wherein the at least one cavity includes at least one cavity disposed about a central section of the bullet.

viii) A bullet according to any one of the preceding combination(s), wherein the at least one cavity includes at least one cavity disposed about a frontward section of the bullet.

ix) A bullet according to any one of the preceding combination(s), wherein the at least one cavity includes a plurality of cavities each being disposed about a corresponding section of the bullet (ex. rearward section, central section and/or forward section, and/or other type of section).

x) A bullet according to any one of the preceding combination(s), wherein the at least one cavity includes a single cavity disposed about a plurality of different sections of the bullet (ex. rearward section, central section and/or forward section, and/or any combination thereof).

xi) A bullet according to any one of the preceding combination(s), wherein the at least one cavity (whether external, internal and/or a combination of both, or whether rearward cavity, central cavity, forward cavity and/or any combination thereof) is configured to be in fluid communication with at least one peripheral orifice provided about a portion of the bullet (whether the at least one peripheral orifice be provided directly on the main body of the bullet and/or on another component thereof).

xii) A bullet according to any one of the preceding combination(s), wherein the at least one peripheral orifice includes at least one peripheral orifice (ex. a rearward orifice) disposed about a rearward surface of the bullet.

xiii) A bullet according to any one of the preceding combination(s), wherein the at least one peripheral surface includes at least one peripheral orifice (ex. a side orifice) disposed about a side surface of the bullet.

xiv) A bullet according to any one of the preceding combination(s), wherein the at least one peripheral orifice includes at least one peripheral orifice (ex. a frontward orifice) disposed about a frontward surface of the bullet.

xv) A bullet according to any one of the preceding combination(s), wherein the at least one peripheral orifice (ex. rearward orifice, side orifice and/or frontward orifice) is configured for allowing a passage of fluid (ex. liquid, gas, vapour, etc.) to and/or from the at least one cavity.

xvi) A bullet according to any one of the preceding combination(s), wherein the at least one peripheral orifice is positioned, shaped and sized for receiving a portion of gun gas from the cartridge (and/or cartridge blast) intended to be introduced into the at least one cavity upon firing of the weapon (ex. rifle, etc.).

xvii) A bullet according to any one of the preceding combination(s), wherein the at least one cavity includes a cross-sectional profile being substantially variable along a given segment of a longitudinal axis of the bullet.

xviii) A bullet according to any one of the preceding combination(s), wherein the at least one cavity includes a cross-sectional profile being substantially constant along a given segment of a longitudinal axis of the bullet.

xix) A bullet according to any one of the preceding combination(s), wherein the at least one cavity includes a substantially circular cross-sectional profile.

xx) A bullet according to any one of the preceding combination(s), wherein the at least one cavity includes at least one substantially cylindrical cavity.

xxi) A bullet according to any one of the preceding combination(s), wherein the at least one cavity has a diameter being smaller than a diameter of the main body of the bullet.

xxii) A bullet according to any one of the preceding combination(s), wherein the at least one peripheral orifice has a cross-sectional area being different from a cross-sectional area of the at least one cavity.

xxiii) A bullet according to any one of the preceding combination(s), wherein the cross-sectional of the at least one peripheral orifice is smaller than a cross-sectional area (ex. a "constant" cross-sectional area and/or an "average" cross-sectional area) of the at least one cavity.

xxiv) A bullet according to any one of the preceding combination(s), wherein the at least one peripheral orifice is provided on a nozzle component defined within the main body of the bullet.

xxv) A bullet according to any one of the preceding combination(s), wherein the nozzle component is made integral (ex. made essentially of the same piece and of the same material) to the main body of the bullet.

xxvi) A bullet according to any one of the preceding combination(s), wherein the nozzle component is a component made separate to (ex. "distinct from", etc.) the main body of the bullet, and is configured for being mountable (ex. inserted, affixed, attached connected, press-fitted, threaded, bonded, welded, and/or etc.) onto the main body of the bullet.

xxvii) A bullet according to any one of the preceding combination(s), wherein the nozzle component is mountable (ex. inserted, affixed, attached, connected, threaded, bonded, welded, and/or etc.) onto a rearward section of the main body of the bullet.

xxviii) A bullet according to any one of the preceding combination(s), wherein the nozzle component is mountable (ex. inserted, affixed, attached, connected, threaded, bonded, welded, and/or etc.) onto a rearward bore section of the main body of the bullet.

xxix) A bullet according to any one of the preceding combinations(s), wherein the nozzle component is configured to be threadedly engaged into the rearward section (and/or corresponding rearward bore section) of the main body of the bullet in a direction of rotation contrary to a direction of rotation of the bullet during flight.

xxx) A bullet according to any one of the preceding combination(s), wherein a portion (ex. outer portion) of the nozzle component is provided with threading, and wherein a portion (ex. inner portion) of the rearward section (and/or corresponding rearward bore section) of the main body of the bullet is provided with a complementary (ex. mating, etc.) threading.

xxxi) A bullet according to any one of the preceding combination(s), wherein the nozzle component is configured to be mechanically-locked (ex. press-fitted, etc.) into the rearward section (and/or corresponding rearward bore section) of the main body of the bullet.

xxxii) A bullet according to any one of the preceding combination(s), wherein the at least one cavity has a diameter being smaller than a diameter of the nozzle component (ex. choke annulus).

xxxiii) A bullet according to any one of the preceding combination(s), wherein the nozzle component has a given length spanning inwardly within the main body of the body, and comprises a fluid passage extending from one end (ex. inner end) to another end (ex. outer end) of the nozzle component.

xxxiv) A bullet according to any one of the preceding combination(s), wherein the fluid passage of the nozzle component includes a cross-sectional profile being substantially variable (ex. tapered, slanted, angled, etc.) along a given segment of a longitudinal axis of bullet.

xxxv) A bullet according to any one of the preceding combination(s), wherein the fluid passage of the nozzle component includes a cross-sectional profile being substantially constant along a given segment of a longitudinal axis of the bullet.

xxxvi) A bullet according to any one of the preceding combination(s), wherein the fluid passage of the nozzle component includes a substantially circular cross-sectional profile.

xxxvii) A bullet according to any one of the preceding combination(s), wherein the fluid passage of the nozzle component includes at least one substantially cylindrical passage.

xxxviii) A bullet according to any one of the preceding combination(s), wherein the fluid passage of the nozzle component is part of a main fluid passage extending from one end (ex. a front end) of the bullet to another end (ex. a rear end) of the bullet.

xxxix) A bullet according to any one of the preceding combination(s), wherein the nozzle component includes an outer surface that is cylindrical.

xl) A bullet according to any one of the preceding combination(s), wherein the nozzle component is a choke annulus.

xli) A bullet according to any one of the preceding combination(s), wherein the nozzle component (and/or corresponding features and/or components thereof) is made via additive manufacturing.

xlii) A bullet according to any one of the preceding combination(s), wherein the at least one cavity is positioned, shaped and sized for containing propellant configured for igniting upon receiving a portion of gun gas from the cartridge (and/or cartridge blast) via the fluid passage (of the nozzle component, for example).

xliii) A bullet according to any one of the preceding combination(s), wherein ignited propellant is in turn configured for exiting the bullet via the fluid passage (whether same passage and/or another one) of the nozzle component in order to further propel the bullet during flight trajectory.

xliv) A bullet according to any one of the preceding combination(s), wherein the main body of the bullet is substantially symmetrical about first and second axes of the bullet (ex. a longitudinal axis and a transversal axis of the bullet—in which case, the bullet would be a "spherical" bullet).

xlv) A bullet according to any one of the preceding combination(s), wherein the main body of the bullet is substantially symmetrical about a single axis of the bullet (ex. a longitudinal axis of the bullet).

xlvi) A bullet according to any one of the preceding combination(s), wherein the main body of the bullet is substantially elongated.

xlvii) A bullet according to any one of the preceding combination(s), wherein the main body of the bullet includes an ogive-shaped portion.

xlviii) A kit with corresponding components for assembling a bullet according to any one of the preceding combination(s).

xlix) A weapon being configured for operating with at least one bullet (and preferably, a plurality of bullets) according to any one of the preceding combination(s).

l) A weapon being provided (ex. loaded, etc.) with at least one bullet (and preferably, a plurality of bullets) according to any one of the preceding combination(s).

li) A weapon according to any one of the preceding combinations(s), wherein the inside of the barrel of the weapon is treated with cold spray.

lii) A weapon according to any one of the preceding combination(s), wherein the weapon is selected from the group consisting of rifle, gun, handgun, machine gun, revolver, automatic weapon, semi-automatic weapon, etc.

liii) A kit with corresponding components for assembling a weapon according to any one of the preceding combination(s).

liv) A method of reducing drag from a bullet propelled out of a barrel of a weapon via a cartridge, the method comprising the step of:

a) providing at least one cavity (ex. at least one internal cavity) about the bullet;

b) recovering a portion of gun gas resulting from a blast of the cartridge during firing of the weapon, and conveying said portion of gun gas into the at least one cavity of the bullet via a corresponding fluid passage; and c) allowing gun gas present inside the at least one cavity of the bullet to exit as the bullet exits the barrel of the weapon, thereby fluidly filling a void behind the bullet during flight trajectory, in order to reduce a resulting drag of the bullet, for an improved overall ballistic performance of the bullet.

lv) A method according to any one of the preceding combination(s), wherein the method further comprises the step of providing additional propellant inside the at least one cavity of the bullet, and triggering an ignition of said additional propellant via a blast of the cartridge.

lvi) A method according to any one of the preceding combination(s), wherein the method further comprises the step of releasing a fluid from an internal portion of the bullet about a peripheral orifice thereof (ex. a tip of the bullet) for reducing skin friction during flight of the bullet.

As may now better be appreciated, the present invention is a substantial improvement over the known prior art in that, by virtue of its design and components, as explained herein, and the particular configuration of the bullet and/or components/accessories thereof according to the present system enable to fire a projectile (ex. a bullet, etc.) in a more efficient, more precise, more accurate, more reliable, more adjustable, more versatile, more adaptable, more impactful, more strategic, more powerful, more lethal and/or more desirable manner (ex. depending on the circumstances, and the intended results, etc.) compared to what is possible with respect to other known conventional bullets and/or methods. Indeed, as previously explained, and depending on the different possible embodiments, the present system also advantageously enables to: a) improve a bullet's structural integrity; b) improve gyroscopic stability; c) improve cargo carrying capabilities; d) a higher muzzle velocity for the same weight of projectile without an increase in breech pressure; e) a base aerodynamic reduction during flight; f) a shorter time of flight to target; and/or etc. Of course, and as can be easily understood by a person skilled in the art, the scope of the present invention should not be limited by the possible embodiments set forth in the examples, but should be given the broadest interpretation consistent with the description as a whole.

Furthermore, although preferred embodiments of the present invention have been briefly described herein and illustrated in the accompanying drawings, it is to be understood that the invention is not limited to these embodiments and that various changes and modifications could be made without departing form the scope and spirit of the present invention, as defined in the appended claims and as apparent to a person skilled in the art.

The invention claimed is:

1. A bullet for use with a cartridge for propulsion out of a barrel of a weapon, the bullet comprising:

a main body acting as a projectile; and a drag-reducing assembly provided about the main body, and configured for being triggered upon a blast from the cartridge, in order to reduce a resulting base drag of the bullet during a flight trajectory, the drag-reducing assembly comprising:

at least one cavity being disposed within a portion of the main body, and being configured for receiving and containing a portion of gun gas from the cartridge and corresponding blast thereof, the at least one cavity including a cross-sectional profile being substantially constant along a given segment of a longitudinal axis of the bullet; and at least one peripheral orifice provided about the main body of the bullet and in fluid communication with the at least one cavity, the at least one peripheral orifice being configured for releasing gun gas from the at least one cavity during the flight trajectory of the bullet, in order to fill a partial vacuum behind the bullet during flight trajectory, and thus reduce the resulting base drag of the bullet during flight trajectory, for an improved overall ballistic performance of the bullet.

2. A bullet according to claim 1, wherein the at least one cavity is completely located internally within the main body of the bullet, and wherein the at least one cavity extends along at least one corresponding section of the bullet selected from the group consisting of a rearward section of the bullet, a central section of the bullet and a frontward section of the bullet.

3. A bullet according to claim 2, wherein the at least one cavity further extends longitudinally along the bullet from one distal end of the bullet to another distal end of the bullet.

4. A bullet according to claim 1, wherein the at least one cavity includes a plurality of cavities each being disposed about a corresponding section of the bullet.

5. A bullet according to claim 1, wherein the at least one cavity includes a single cavity disposed about a plurality of different sections of the bullet.

6. A bullet according to claim 1, wherein the at least one peripheral orifice is configured for allowing a passage of fluid in and out from the at least one cavity.

7. A bullet according to claim 1, wherein the at least one peripheral orifice is positioned, shaped and sized for receiving a portion of gun gas from the cartridge and blast thereof intended to be introduced into the at least one cavity upon firing of the weapon.

8. A bullet according to claim 1, wherein the at least one peripheral orifice includes at least one corresponding peripheral orifice selected from the group consisting of at least one rearward peripheral orifice disposed about a rearward surface of the bullet, at least one side peripheral orifice disposed about a side surface of the bullet and at least one frontward peripheral orifice disposed about a frontward surface of the bullet.

9. A bullet according to claim 1, wherein the at least one cavity includes a substantially circular cross-sectional profile along the given segment of the longitudinal axis of the bullet;

wherein the at least one cavity includes at least one substantially cylindrical cavity extending along the given segment of the longitudinal axis of the bullet;

wherein the at least one cavity has a diameter being smaller than an outer diameter of the main body of the bullet; and wherein a cross-sectional area of the at least one peripheral orifice is smaller than a cross-sectional area of the at least one cavity.

10. A bullet according to claim 1, wherein the at least one peripheral orifice defines an angle diverging rearwardly with respect to the longitudinal axis of the bullet; wherein said angle is between 10 degrees and 70 degrees; and wherein preferably said angle is between 20 degrees and 60 degrees; and wherein preferably said angle is between 30 degrees and 45 degrees.

11. A bullet according to claim 1, wherein the drag-reducing assembly comprises a nozzle component provided about the main body of the bullet, and wherein the at least one peripheral office is provided on said nozzle component.

12. A bullet according to claim 11, wherein the nozzle component is made integral to the main body of the bullet.

13. A bullet according to claim 11, wherein the nozzle component is a component made separate to the main body of the bullet, and is configured for being removably mountable onto the main body of the bullet.

14. A bullet according to claim 13, wherein the nozzle component is mountable onto a rearward section of the main body of the bullet;

wherein the nozzle component is mountable onto a rearward bore section of the main body of the bullet;

wherein the nozzle component is configured to be threadedly engaged into the rearward section of the main body of the bullet in a direction of rotation contrary to a direction of rotation of the bullet during flight;

wherein a portion of the nozzle component is provided with threading, and wherein a portion of the rearward section of the main body of the bullet is provided with a complementary threading;

wherein the nozzle component is configured to be mechanically-locked into the rearward section of the main body of the bullet; and wherein the at least one cavity has a diameter being smaller than a diameter of the nozzle component.

15. A bullet according to claim 11, wherein the nozzle component has a given length spanning inwardly within the main body of the body, and comprises a fluid passage extending from one end to another end of the nozzle component, said fluid passage coinciding with the at least one peripheral orifice;

wherein the fluid passage of the nozzle component includes a cross-sectional profile being substantially variable along a given span;

wherein the fluid passage of the nozzle component includes a cross-sectional profile being substantially constant along a given span;

wherein the fluid passage of the nozzle component includes a substantially circular cross-sectional profile;

wherein the fluid passage of the nozzle component includes at least one substantially cylindrical passage;

wherein the nozzle component includes an outer surface that is cylindrical; and wherein the nozzle component includes a choke annulus.

16. A bullet according to claim 11, wherein the drag-reducing assembly comprises a perforated cap being operatively mounted onto the nozzle component;

wherein the perforated cap comprises a central opening; and wherein the perforated cap comprises a series of peripheral holes forming together a plurality of orifices defining a plurality of fluid passages.

17. A bullet according to claim 15, wherein the nozzle component is made via additive manufacturing.

18. A bullet according to claim 11, wherein the at least one cavity is positioned, shaped and sized for containing propellant configured for igniting upon receiving a portion of gun gas from the cartridge and corresponding blast thereof via the fluid passage of the nozzle component;

wherein ignited propellant is in turn configured for exiting the bullet via the fluid passage of the nozzle component in order to further propel the bullet during flight trajectory;

wherein the fluid passage of the nozzle component is part of a main fluid passage extending from one distal end of the bullet to another distal end of the bullet;

wherein the at least one cavity is positioned, shaped and sized for containing material capable of being converted from a given state to a vapor state, said material being configured for igniting upon receiving a portion of gun gas from the cartridge and corresponding blast thereof;

wherein the at least one cavity is separated from the material capable of being converted from a given state to a vapor state via a corresponding membrane; and wherein vapor discharge is released from the at least one cavity, and out from a front end of the bullet, in order to engulf the main body of the bullet during flight with said vapor discharge, and provide the bullet with an additional reduction of drag during flight, said additional reduction of drag being selected from the group consisting of frontal drag, skin drag and base drag.

19. A bullet according claim 18, wherein the main body of the bullet is substantially symmetrical about a single axis of the bullet, said single axis corresponding to the longitudinal axis of the bullet;

wherein the main body of the bullet is substantially elongated; and wherein the main body of the bullet includes an ogive-shaped portion.

20. A weapon having a barrel being provided with at least one bullet according to claim 1, wherein an inside of the barrel of the weapon is treated with cold spray, and wherein the weapon is selected from the group consisting of rifle, gun, handgun, machine gun, revolver, automatic weapon, and semi-automatic weapon.

* * * * *